US007573387B2

(12) United States Patent
Shimazu et al.

(10) Patent No.: US 7,573,387 B2
(45) Date of Patent: Aug. 11, 2009

(54) CONTINUOUS PAPER PROCESSING SYSTEM

(75) Inventors: Ryoji Shimazu, Otsu (JP); Hideaki Sugio, Otsu (JP); Yasuhisa Mizuno, Otsu (JP)

(73) Assignee: Toray Engineering Co., Ltd., Tokyo (JP)

( * ) Notice: Subject to any disclaimer, the term of this patent is extended or adjusted under 35 U.S.C. 154(b) by 323 days.

(21) Appl. No.: 11/596,889

(22) PCT Filed: Jun. 20, 2005

(86) PCT No.: PCT/JP2005/011284

§ 371 (c)(1),
(2), (4) Date: Nov. 17, 2006

(87) PCT Pub. No.: WO2005/124666

PCT Pub. Date: Dec. 29, 2005

(65) Prior Publication Data

US 2007/0241903 A1 Oct. 18, 2007

(30) Foreign Application Priority Data

Jun. 22, 2004 (JP) ..... 2004-183870

(51) Int. Cl.
*G08B 13/14* (2006.01)

(52) U.S. Cl. ..... 340/572.1; 340/572.4; 340/572.8

(58) Field of Classification Search ..... 340/572.1, 340/572.4, 572.8, 572.9, 539.11, 10.1; 235/375, 235/383, 435, 462.46, 472.01; 493/386
See application file for complete search history.

(56) References Cited

U.S. PATENT DOCUMENTS

| | | | | |
|---|---|---|---|---|
| 4,247,289 | A * | 1/1981 | McCabe | 493/386 |
| 5,866,023 | A * | 2/1999 | Monson | 235/472.01 |
| 7,104,439 | B2 * | 9/2006 | Dewan et al. | 235/375 |
| 7,298,263 | B2 * | 11/2007 | Gielis | 340/572.1 |
| 2003/0227528 | A1 * | 12/2003 | Hohberger et al. | 347/104 |

FOREIGN PATENT DOCUMENTS

| | | | |
|---|---|---|---|
| JP | 9-265562 | A | 10/1997 |
| JP | 10-091745 | A | 4/1998 |
| JP | 2001-039609 | A | 2/2001 |
| JP | 2002-254759 | A | 9/2002 |
| JP | 2003-058856 | A | 2/2003 |
| JP | 2003-191668 | A | 7/2003 |
| JP | 2004-118625 | A | 4/2004 |

* cited by examiner

*Primary Examiner*—Van T. Trieu
(74) *Attorney, Agent, or Firm*—Birch, Stewart, Kolasch & Birch, LLP

(57) ABSTRACT

A continuous paper processing system comprises a post-processing device for continuous paper equipped with at least one RFID tag, an RFID reader for reading electronic information written in the RFID tag, storage device that stores check information to be checked against the electronic information read by the RFID reader, and check device that checks the electronic information read by the RFID reader against the check information.

26 Claims, 6 Drawing Sheets

CONTINUOUS PAPER PROCESSING SYSTEM

TECHNICAL FIELD

The present invention relates to a continuous paper processing system for continuous paper equipped with at least one RFID tag, and more particularly, to a continuous paper processing system that checks the information read from the RFID tag or a visible information reader against check information when the continuous paper is subjected to post processing by a post-processing device.

BACKGROUND ART

In place of conventional magnetic cards and contact IC cards, an RFID tag using a contact-free readable and writable IC chip has been developed. As it is not necessary to bring an RFID tag into contact with a reading and a writing device when information is read and written, the RFID tag is expected to be an alternative to a bar code and a two-dimensional code especially in logistics.

In logistics and other fields, a bar code and a two-dimensional code (hereinafter referred to as visible information) are extensively used, so that the visible information is sometimes printed on a recording medium side by side with an RFID tag.

It is impossible for humans, however, to read the contents of an RFID tag and bar code merely at the sight of them. Therefore, in the event that incorrect data is written in the RFID tag or bar code, this is not instantly recognizable.

According to conventional art, the creation, editing, control and the like of the visible information and those of electronic data written in an RFID tag (hereinafter also referred to as RFID data) are usually performed using separate applications. This makes it difficult to ensure the consistency between the contents of the visible information and the RFID data written in the RFID tag.

There has been another problem that the total operating efficiency is deteriorated if the process of checking visible information and RFID data is separately carried out after the process of printing the visible information and the like on the recording medium and of writing the RFID data in the RFID tag-provided to the recording medium, and the like.

DISCLOSURE OF THE INVENTION

The present invention has been made to solve the above-mentioned problems. It is an object of the invention to provide a continuous paper processing system capable of efficiently verifying whether correct information is provided to continuous paper equipped with at least one RFID tag.

In order to achieve the object, the continuous paper processing system of the present invention is a continuous paper processing system for continuous paper equipped with at least one RFID tag, comprising a post-processing device for the continuous paper, an RFID reader for reading electronic information written in the RFID tag, storage means arranged for storing check information to be checked against the electronic information read by the RFID reader, and check means arranged for checking the electronic information read by the RFID reader against the check information.

The above-described constitution makes it possible to check the electronic data of the RFID tag, which has been read by the RFID reader, while performing post-processing, for example, folding, of continuous paper equipped with the RFID. As a result, a check operation can be efficiently performed without setting another process for an additional check.

In the continuous paper processing system, the storage means preferably stores as log information at least any one of the electronic information read by the RFID reader, the check information used for the check conducted by the check means, and result information of the check by the check means.

Alternatively, the system further comprises log storage means arranged for storing as log information at least any one of the electronic information read by the RFID reader, the check information used for the check by the check means, and result information of the check by the check means.

With the above-described constitution, when it is determined that the data of an RFID tag is not correct, a judgment can be easily made as to which RFID tag includes the incorrect data because the log information is saved.

In order to accomplish the above-mentioned object, the continuous paper processing system according to another aspect of the present invention is a continuous paper processing system for continuous paper equipped with at least one RFID tag and printed with visible information. The system comprises a post-processing device for the continuous paper, an RFID reader for reading electronic information written in the RFID tag, a visible information reader for reading the visible information, and check means arranged for checking the electronic information read by the RFID reader against electronic information read by the visible information reader.

The above-described constitution makes it possible to check the electronic data of the RFID tag, which has been read by the RFID reader, against the electronic data that has been read by the visible information reader while performing post-processing, for example, folding, of continuous paper equipped with the RFID. As a result, a check operation can be efficiently performed without setting another process for an additional check.

Preferably, the continuous paper processing system further comprises storage means arranged for storing as log information at least any one of the electronic information read by the RFID reader, the electronic information read by the visible information reader, and result information of the check by the check means.

With the above-described constitution, a judgment can be easily made on the basis of the log information, as to which RFID tag includes incorrect data.

To be more specific, the storage means includes log storage means arranged for storing as log information at least any one of the electronic information read by the RFID reader, the electronic information read by the visible information reader, and the result information of the check by the check means, and check-information storage means arranged for storing check information to be checked against the electronic information read by the RFID reader and/or the electronic information read by the visible information reader. The check means further checks the electronic information read by the RFID reader and/or the electronic information read by the visible information reader against the check information.

Alternatively, to be concrete, the storage means further stores check information to be checked against the electronic information read by the RFID reader and/or the electronic information read by the visible information reader. The check means further checks the electronic information read by the RFID reader and/or the electronic information read by the visible information reader against the check information.

In the continuous paper processing system, preferably the check means further checks the electronic information read by the RFID reader and/or the electronic information read by the visible information reader against check information, and the continuous paper processing system further comprises storage means arranged for storing the check information and also storing as log information at least any one of the electronic information read by the RFID reader, the electronic information read by the visible information reader, the check information used for the check by the check means, and result information of the check by the check means.

More specifically, the storage means includes check-information storage means arranged for storing the check information, and log storage means arranged for storing as log information at least any one of the electronic information read by the RFID reader, the electronic information read by the visible information reader, the check information used for the check by the check means, and the result information of the check by the check means.

It is preferable that the visible information includes a bar code or two-dimensional code, and that the visible information reader has a function for reading the bar code or two-dimensional code.

In order to achieve the above-mentioned object, the continuous paper processing system according to another aspect of the present invention is a continuous paper processing system for continuous paper equipped with at least one RFID tag. The system comprises a post-processing device for the continuous paper, an RFID writer for writing electronic information in the RFID tag, an RFID reader for reading the electronic information from the RFID tag, and check means arranged for checking the electronic information written by the RFID writer against the electronic information read by the RFID reader.

In addition to the aforementioned advantage, with the above-described constitution, even if there is no data written in the RFID tag, it is possible to write the visible information, such as a bar code, a two-dimensional code, or an OCR word, or reference data obtained from data base into the RFID, and to check later again, by the RFID reader, whether they have been correctly written.

Preferably, the continuous paper processing system further comprises recording means arranged for storing as log information at least any one of the electronic information written in the RFID tag by the RFID writer, the electronic information read by the RFID reader, and result information of the check.

With the above-described constitution, a judgment can be easily made on the basis of the log information, as to which RFID tag includes incorrect data.

Preferably, the continuous paper processing system further comprises marking means arranged for giving marking onto the RFID tag or onto a nearby place from the tag on the continuous paper on the basis of a check result of the check means.

With the above-described constitution, when it is determined that the data of an RFID tag is not correct, the marking means gives marking onto the RFID tag or onto a nearby place from the tag on a recording medium. It is then possible to easily make a determination as to which RFID tag includes incorrect data.

Further preferably, the continuous paper processing system further comprises a correction RFID writer disposed downstream of the RFID reader as viewed in a feeding direction of the continuous paper for writing electronic information in the RFID tag on the basis of a check result of the check means.

With the above-described constitution, when it is determined that the data of an RFID tag is not correct, correct data can be overwritten by the RFID writer disposed downstream from the RFID reader as viewed in the feeding direction of the continuous paper.

Further preferably, the post-processing device can be alternately switched between a post-processing operation mode in which at least the feed of the continuous paper is performed and a standby mode in which the feed of the continuous paper is not performed. In the standby mode, writing of electronic information into the RFID tag by the RFID writer or the correction RFID writer, and/or marking of the marking means is performed.

The RFID sends and receives data through an electric wave. For this reason, there is occasionally a limit to write/read of a large quantity of data with respect to an RFID tag on moving continuous paper. With the above-described constitution, however, if the post-processing device is properly controlled between the post-processing operation mode and the standby mode, and if the electronic information is written into the RFID tag in the standby mode, it is possible to carry out the write/read of a large quantity of electronic data.

It is also preferable that the post-processing device be a folding device.

Further preferably, the continuous paper previously has fold lines at regular intervals, and the RFID tags is attached onto the continuous paper on the basis of positions of the fold lines.

Preferably, in the continuous paper processing system for continuous paper equipped with an RFID tag and printed with visible information, the RFID tag is attached on the continuous paper or the visible information is printed on the continuous paper.

Further preferably, either one of the electronic information maintained in the RFID tag and the visible information includes a portion or key code of the other, or a portion or key code of the check information.

BEST MODE OF CARRYING OUT THE INVENTION

A constitution of the present invention will be described below in detail with reference to the drawings.

Figure 1:
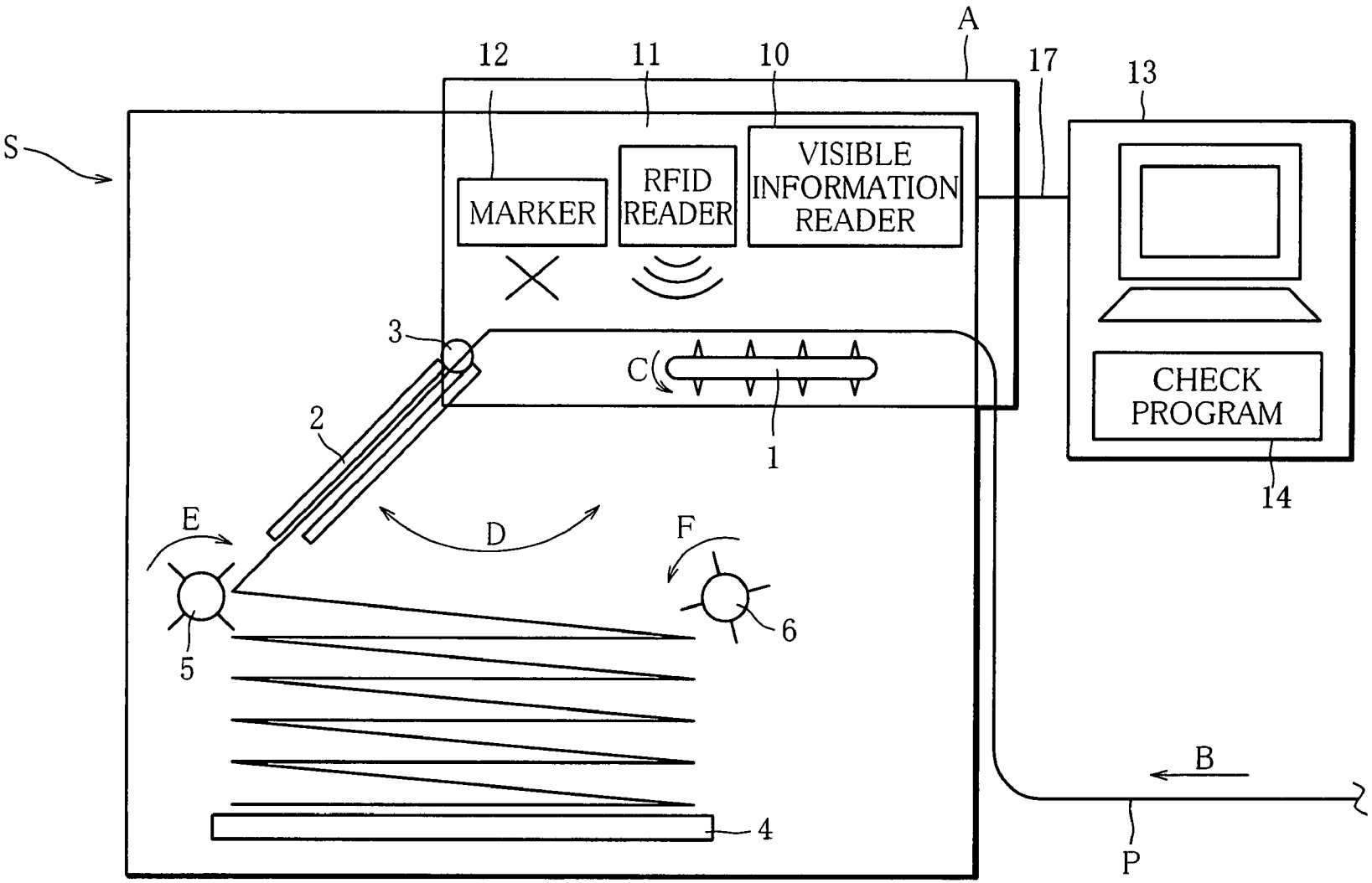
FIG. 1 is a block diagram showing an RFID verification system using a folding device as one embodiment of the present invention.

FIG. 1 is an explanatory view of a continuous paper processing system according to one embodiment of the invention. In the continuous paper processing system, a continuous paper-folding device S is provided with a visible information reader 10, an RFID reader 11, and a marker 12.

In FIG. 1, P represents continuous paper to be folded, which is equipped with an RFID tag, not shown. An RFID chip with a communication antenna is called an RFID tag here. The RFID tag may be attached onto either a front or back side of the continuous paper P. Alternatively, the RFID tag may be embedded (implanted in a process of manufacturing paper) in the continuous paper P. The continuous paper P may be in the form of piled papers with RFIDs sandwiched therebetween.

Sprocket holes are formed in both side edges of the continuous paper P at regular intervals as viewed in a feeding direction. A tractor 1 rotates in a direction of arrow C with tractor pins inserted in the sprocket holes of the continuous paper P, thereby feeding the continuous paper P at a constant rate in a direction of arrow B.

A swinger 2 swings back and forth as shown by arrow D with a swinger fulcrum 3 used as a fulcrum of the swing while feeding the continuous paper P to the inside thereof. In other words, the swinger 2 swings to a position shown in FIG. 1 with timing when a mountain-fold line of the continuous paper P comes close to a tip end of the swinger 2, and swings to a position obtained by flipping substantially horizontally with a line extending perpendicularly downward from the swinger fulcrum 3 used as a center with timing when a valley-fold line comes close to the tip end of the swinger 2. The swinger 2 repeats such movement to feed the continuous paper P while folding the paper P on a table 4 according to folding directions of original fold lines.

The table 4 is a table to be surmounted by the folded continuous paper P. The table 4 automatically descends according to the amount of the continuous paper P folded on the table 4 by means of a descent mechanism, not shown.

Paddles 5 and 6 are a pair of paddle units forming a paddle member. Fixed to the paddles 5 and 6 are rubber plates having proper elasticity. The paddles 5 and 6 are so constructed as to press fold-line portions of the continuous paper P by being individually rotated in directions of arrows E and F, respectively, by means of a drive mechanism, not shown.

The RFID reader 11 is disposed above the tractor 1. The RFID reader 11 and the RFID tag on the continuous paper P fed by the tractor 1 exchange electronic data through an electric wave.

The visible information reader 10 is disposed for the purpose of reading visible information printed on the continuous paper P. The visible information here means code information including a bar code or a two-dimensional code, an OCR word, etc. Contents of the visible information are referred to as visible information data. A device for reading a bar code, a two-dimensional code, an OCR word, or the like, with a linear sensor-or camera and converting them into electronic data is called a visible information reader. In FIG. 1, the visible information reader 10 is located upstream of the RFID reader 11 as viewed in the feeding direction of the continuous paper P, but may be disposed downstream from or in the same position as the RFID reader 11.

The marker 12 prints on the continuous paper P a mark (marking) that is visually recognizable. As the marker 12, an inkjet marker, a so-called stamp used to affix a red seal by putting pressure, and a stamp-like article may also be employed. The marker 12 is operated if a result of a check program executed by an after-mentioned controller 13 tells that incorrect data is written in RFID data.

The controller 13 is connected to the folding device S through a communication cable 17. The controller 13 controls the start/stop of a folding operation of the folding device S, and receives data from the RFID reader 11 and visible information reader 10. The folding operation corresponds to the post-processing operation for the continuous paper.

A check program 14 is executed in the controller 13. The check program 14 shows a check result on a screen of the controller 13 and stores log information, taking as input the RFID data transmitted from the RFID reader 11 and the visible information data transmitted from the visible information reader 10.

Figure 2:
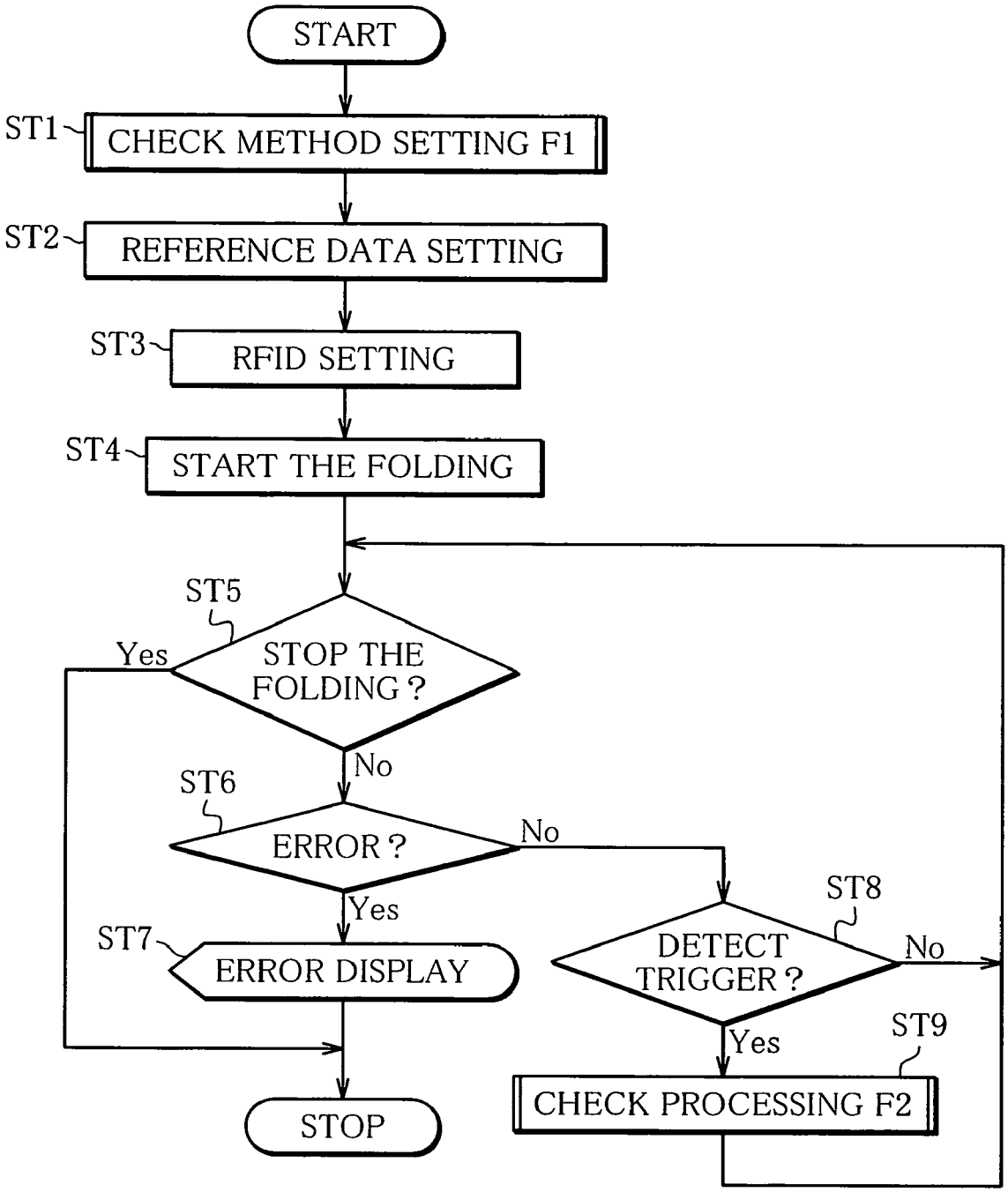
FIG. 2 is a flowchart showing a process of a check program according to the present invention.

FIG. 2 illustrates a flowchart showing a process of the check program 14 of FIG. 1. The check program performs check processing on the basis of check method setting, reference data setting, and RFID setting which are preset by the operator in Steps ST1 to ST3. The check method setting of Step ST1 is to set a method of conducting a check and will be described later in detail with reference to FIG. 3. The reference data setting of Step ST2 is to set kind and position information of data to be checked against the RFID data.

Kinds of the reference data include visible information data, such as a bar code, a two-dimensional code, and an OCR word, and electronic information data, such as a database and a CSV file (comma separated value file). For example, if a bar code is chosen, a kind of the code, such as Code 39 or NW-7, is also chosen at the same time.

As to the position information, the setting is performed as to where on the paper the visible information is printed when the visible information such as a bar code is chosen. The position information is necessary for calculating offset time from a trigger signal serving as reference in check processing described below.

The RFID setting of Step ST3 is to set kind and position information of an RFID tag. As to the position information, just like that of the reference data setting, the setting is performed as to where on the paper the RFID tag is located.

In Step ST4, upon receipt of the operator's instructions to start, the controller 13 sends a folding start command to the folding device S, and subsequently repeats processing described below in Steps ST5 to ST9 until receiving the operator's instructions to stop.

(1) If there are any errors occurring in the folding device S, the controller 13 informs the operator of an error and ends the routine. If there is no error, the routine advances to the next processing (Steps ST5 to ST7).

(2) Upon receipt of trigger signals synchronized with fold lines of the continuous paper from the folding device, the controller 13 performs check processing described below (Steps ST8 to ST9).

Figure 3:
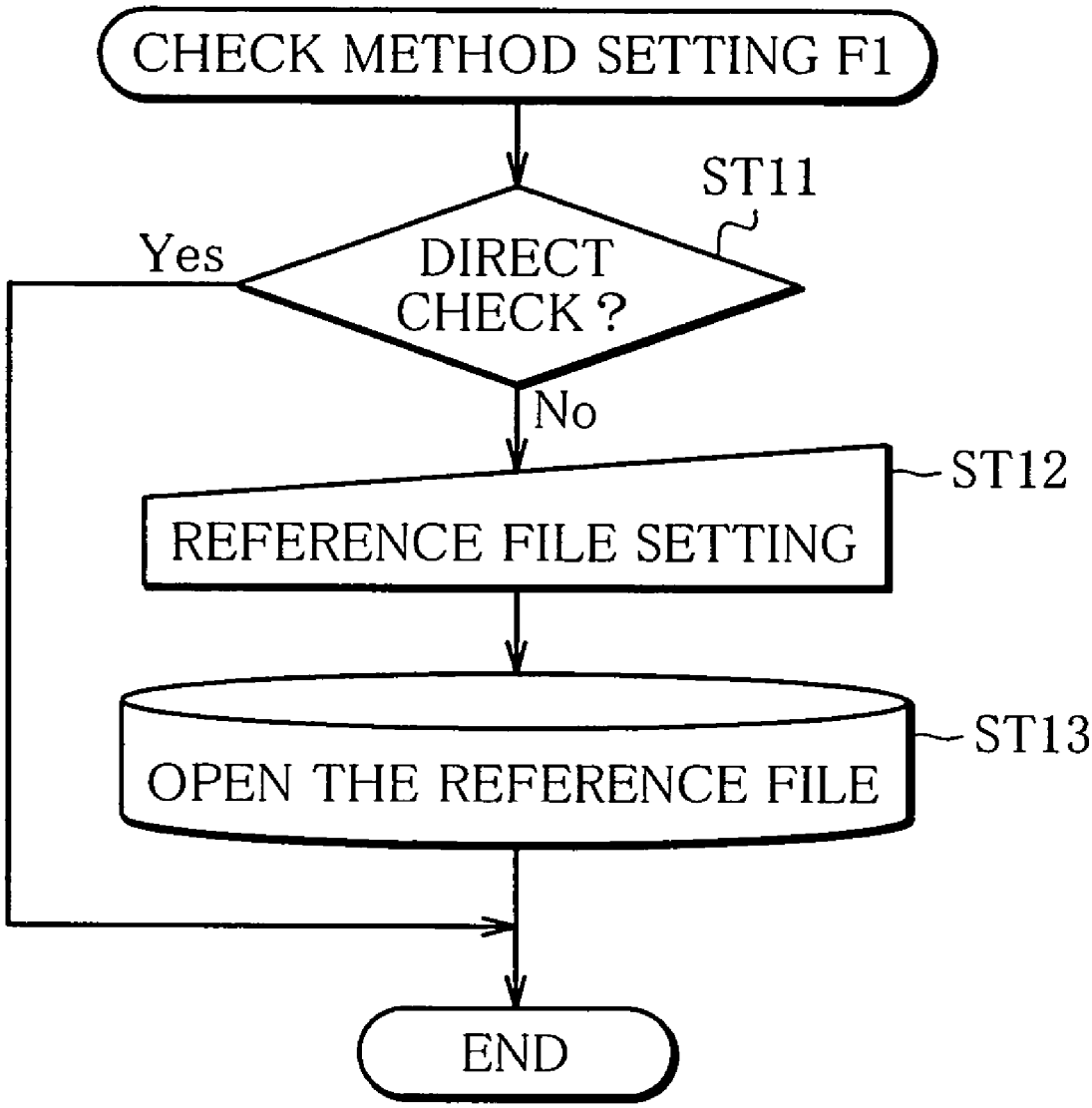
FIG. 3 is a flowchart showing a process of setting a check method in the check program according to the present invention.

FIG. 3 is a flowchart that specifically explains check method setting F1 performed in Step ST1 of the flowchart in FIG. 2.

In the check method setting F1, a determination is first made as to whether the check is direct check or indirect check (Step ST11). The direct check is to compare the RFID data to data obtained from the visible information, such as a bar code or a two-dimensional code. The indirect check is to derive comparison data serving as check information from a database or CSV file on the basis of data obtained from the visible information, and then to compare the derived comparison data to the RFID data.

If the indirect check is chosen, the operator performs the setting as to where a reference file exists (Step ST12). The reference file here means a database or CSV file. The reference file may be located in a storage device (storage means, check-information storage means) such as a hard disk of the controller 13 or in a storage device (storage means, check-information storage means) on a network connected to the controller 13. Since the reference file is frequently accessed during the check processing, it is preferable that the reference file be copied in a main storage device (memory) of the controller 13. For this reason, it is better to perform processing to open the reference file before the check processing is started (Step ST13).

Either one of the RFID data stored in the RFID tag and the visible information data such as a bar code is not necessarily all of the other or of the check information in the reference file, but it may be a portion of the other or of the check information in the reference file. The RFID data and the visible information data may also be a code number for identifying data in the reference file, which is a so-called key code, record number, etc.

Figure 4:
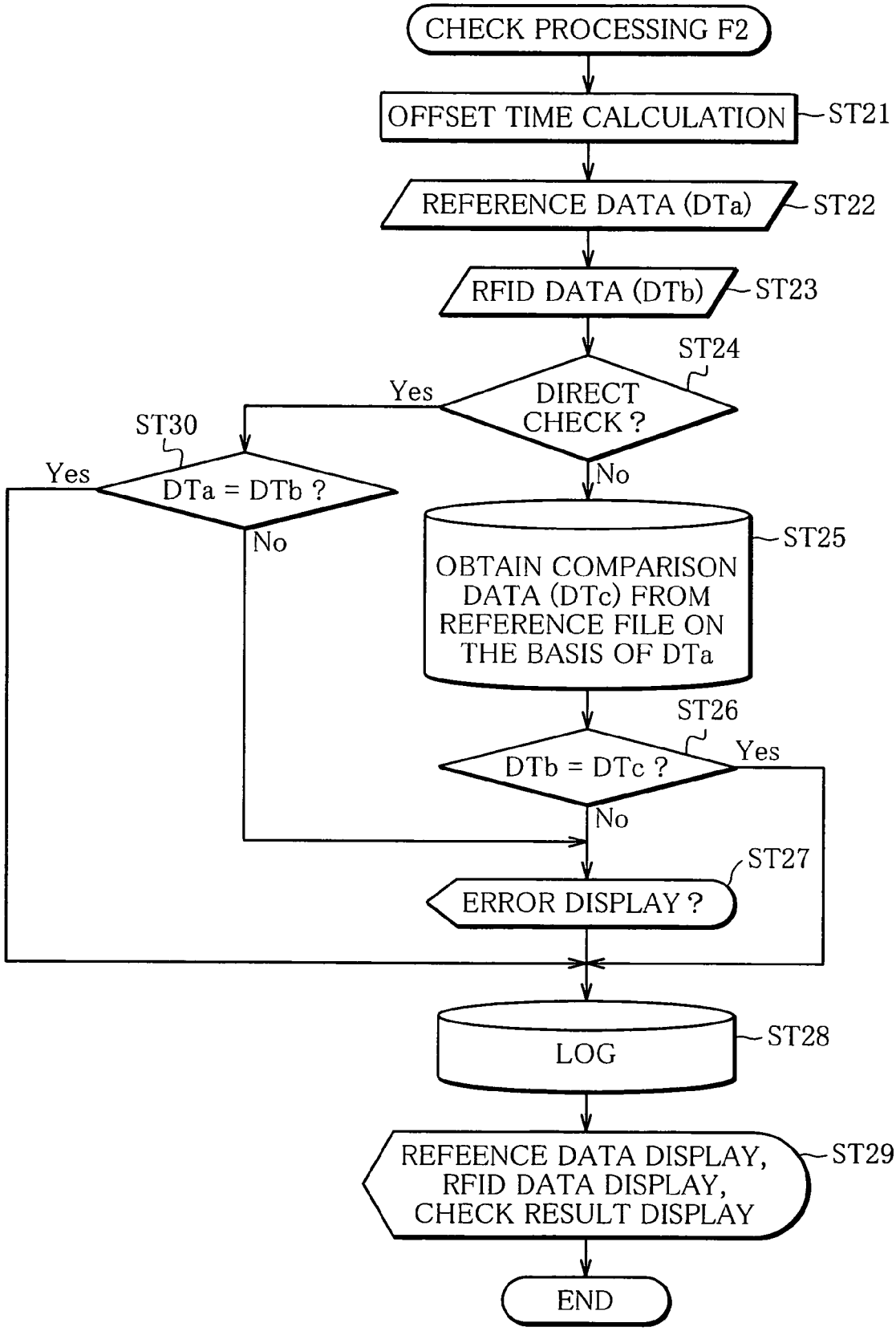
FIG. 4 is a flowchart showing a process of check processing in the check program according to the present invention.

FIG. 4 is a flowchart that specifically explains check processing F2 of the flowchart in FIG. 2. First, when the processing of the flowchart is carried out, if the reference data is the visible information data such as a bar code, the offset time from the trigger signal received in FIG. 2 is calculated (Step ST21). The calculation of the offset time from the trigger signal is shown below.

Reference data offset time=Position information of reference data/Feed rate of recording medium P As to the RFID data, the offset time from the trigger signal is calculated in the same manner (Step ST21). The calculation of the offset time from the trigger signal is shown below.

RFID offset time=Position information of RFID tag/Feed rate of recording medium P The trigger signal of the folding device is received, and then reference data DTa is obtained after lapse of the reference data offset time (Step ST22), and RFID data DTb is obtained after lapse of RFID offset time (Step ST23).

In the case of the direct check (Step ST24), when both the reference data DTa and the RFID data DTb are obtained, comparison is made (Step ST30). If it is determined that the reference data DTa and the RFID data DTb do not coincide with each other, an error display indicative of the inconsistency is presented on the screen of the controller 13 (Step ST27), and then the log information is stored (Stop ST28). Subsequently, the reference data DTa, the RFID data DTb and a check result are shown on the screen of the controller 13 (Step ST29).

If it is determined that the reference data DTa and the RFID data DTb coincide with each other (Step ST26), the error display is not presented. The log information is stored (Step ST28), and the reference data DTa, the RFID data DTb and the check result are shown on the screen (Step ST29).

The log information here means not only the reference data DTa, the RFID data DTb, and the check result but also the time when the check is performed and a number indicating what number data from the start of the check is the data currently checked. They are stored in the storage device (storage means, log storage means) such as a hard disk of the controller 13.

A device for storing the comparison data that is check information may serve as the storage device for storing the log information at the same time, or alternatively, another storage device may be employed as the storage device for storing the log information.

If the log information is stored all the time as stated previously, the check result can be verified even later.

On the other hand, in the case of the indirect check (Step ST24), comparison data DTc is obtained from the reference file on the basis of the reference data DTa (Step ST25). The comparison data DTc is compared to the RFID data DTb (Step ST26). If it is determined that they do not coincide with each other, an error display indicative of the inconsistency is presented on the screen of the controller 13 (Step ST27). Thereafter, the log information is stored (Step ST28), and the comparison data DTc, the RFID data DTb and the check result are displayed on the screen (Step ST29).

If it is determined that the comparison data DTc and the RFID data DTb coincide with each other, the error display is not presented. The log information is stored (Step ST28), and the comparison data DTc, the RFID data DTb and the check result are displayed on the screen (Step ST29). In this manner, a series of check processing is performed.

Figure 5:
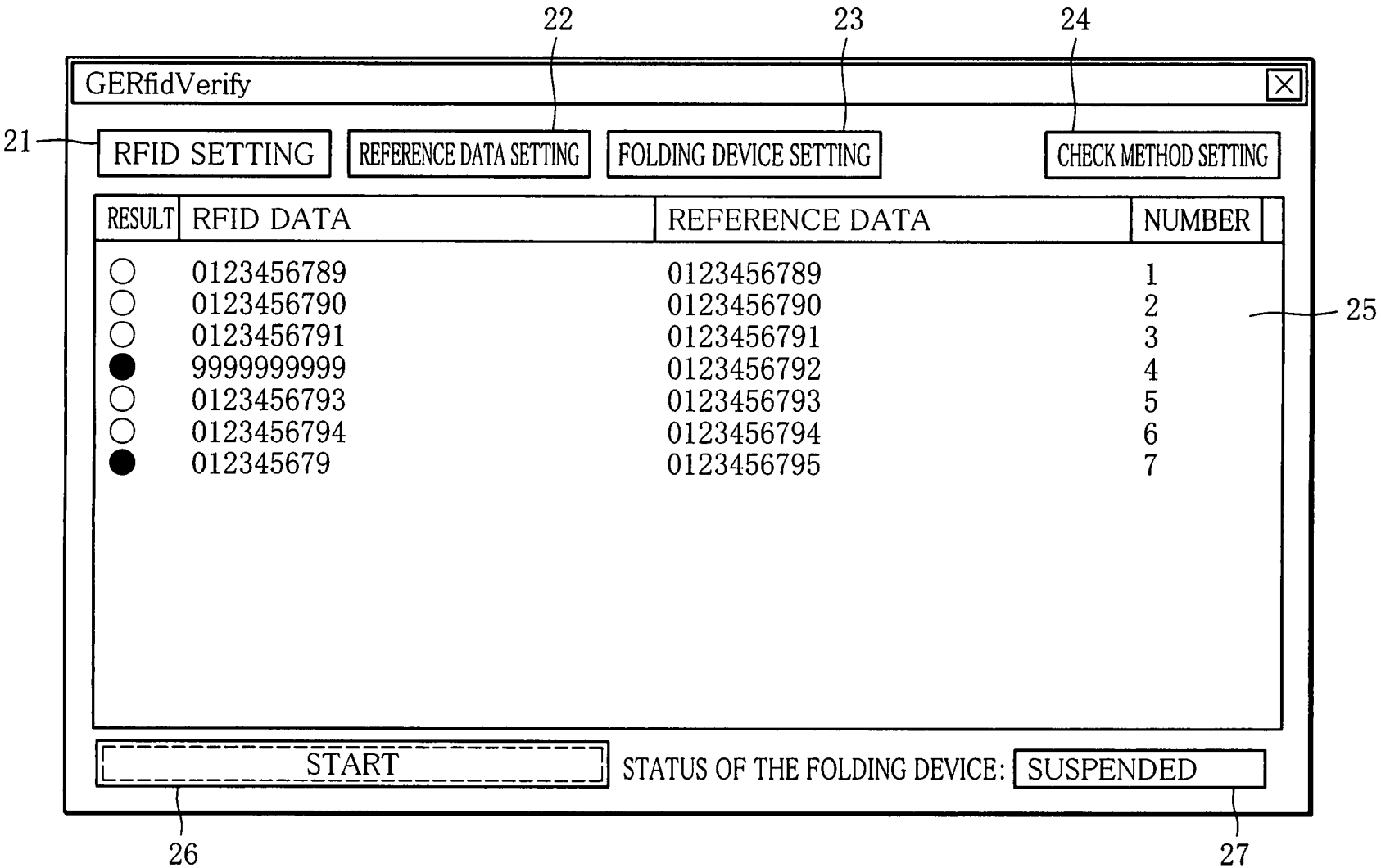
FIG. 5 is a view showing one example of an operation window in the check program according to the present invention.

FIG. 5 shows an operation window of the check program 14 according to the present invention. The operation window includes setting buttons (21 to 24) for performing various kinds of setting, a result window (25) that indicates a check result, a start/stop button (26) for controlling the start/stop of the check processing, and a status indication (27) that indicates a current status of the folding device S.

When the setting button 21 for RFID is pressed, an RFID-setting window appears, and the RFID setting explained above with reference to FIG. 2 can be carried out. When the setting button 22 for the reference data is pressed, a reference-data setting window appears, and the reference-data setting explained above with reference to FIG. 2 can be performed. When the setting button 23 for the folding device is pressed, there appears a setting window for setting the feed rate of the folding device S and distance between fold lines (so-called top-and-bottom length) of the continuous paper P. Based on the setting, the folding device S is controlled. When the setting button 24 for the check method is pressed, there appears a setting window for choosing between the direct check and the indirect check explained with reference to FIG. 3 and identifying the location of the reference file in case that the indirect check is chosen.

The result window 25 shows a result of the check, the RFID data, the reference data, and a number indicating what number data from the start of the check is the data currently checked. If a result of the RFID data and that of the reference data are identical, mark "○" is displayed in a result column of the result window 25. If the results are different, mark "●" is displayed. By so doing, the operator can confirm a check result at once.

The start/stop button 26 is a button for commanding start/stop of the check processing. By pressing this button, the start/stop of the folding operation of the folding device and the start/stop of the check processing are controlled.

The folding-device status indication 27 shows a current status of the folding device S. In the event that interruption such as jam occurs in the folding device S, the kind of the interruption is displayed.

As described above, in the folding device for continuous paper, the electronic data of the RFID tag, which is read from the RFID attached to the continuous paper by the RFID reader 11 is checked against and compared with the data obtained from the visible information read by the visible information reader 10 on the basis of a bar code, two-dimensional code or OCR word printed on the continuous paper. Consequently, it is possible to efficiently and rapidly carry out the check work without providing additional step of conducting the check.

Figure 6:
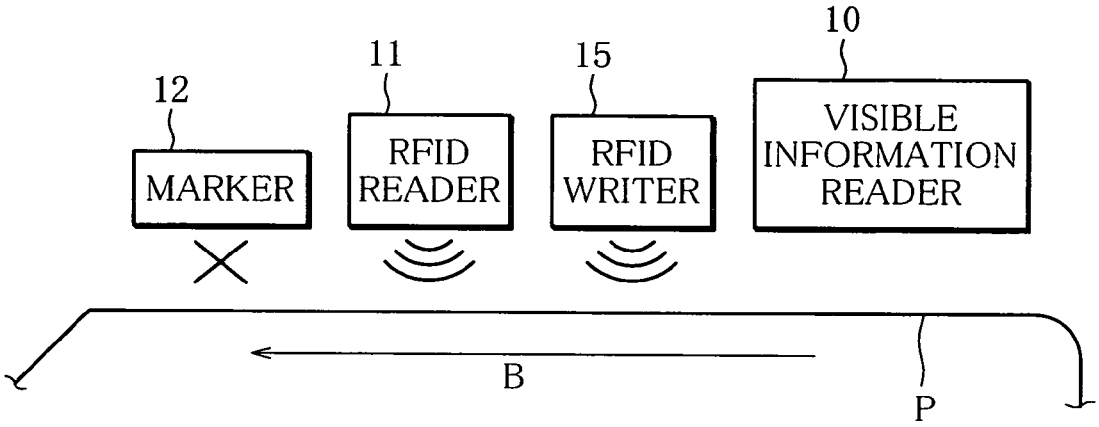
FIG. 6 is an enlarged view of a main part of an RFID write/verification system using a folding device according to another embodiment of the present invention.

FIG. 6 is a view of another embodiment of the present invention, showing a portion A of FIG. 1 in an enlarged scale. A difference from FIG. 1 is that an RFID writer 15 is disposed upstream from the RFID reader 11 as viewed in the feeding direction of the continuous paper P.

The above-described constitution makes it possible to write data into the RFID tag using the RFID writer 15 even if there is no data written into the RFID tag that is attached to the continuous paper P.

The RFID writer 15 has the same principle as the RFID reader 11, and sends and receives data through an electric wave. The data written into the RFID tag may be data that is led from the database or the reference file, such as a CSV file, or may be data obtained by reading visible information such as a bar code which is printed on the continuous paper P by using the visible information reader 10.

The check processing as described above can be carried out if the RFID reader 11 is installed downstream of the RFID writer 15, so that a series of processing from the write to the check processing can be completed in a single system.

Since the RFID sends and receives data through an electric wave, there is a limit to the sending and receiving of a large quantity of data with respect to the moving RFID tag. Therefore, in the folding device S, the position of the RFID tag on the continuous paper P is temporarily stopped at the position of the RFID writer 15 by controlling the start/stop of the folding operation. By controlling the start/stop of the folding operation in this way, it is possible to write a large quantity of data into the RFID tag.

Figure 7:
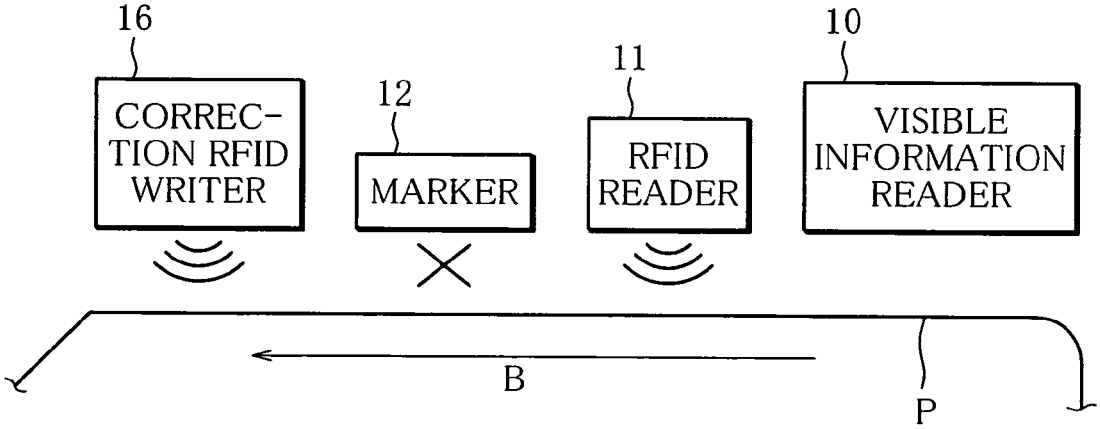
FIG. 7 is an enlarged view of a main part of an RFID write/verification/correction system using a folding device according to further another embodiment of the present invention.

FIG. 7 is a view of further another embodiment of the present invention, showing the portion A of FIG. 1 in an enlarged scale. A difference from FIG. 1 is that a correction RFID writer 16 is disposed downstream of the marker 12 as viewed in the feeding direction of the continuous paper P.

The correction RFID writer 16 is for writing data in the RFID tag like the RFID writer 15 of FIG. 6. In this embodiment, the above-mentioned check processing is performed. If the RFID data and the reference data do not coincide with each other, correct data can be written again by the correction RFID writer 16.

Furthermore, since the RFID writer 15 is disposed upstream from the RFID reader 11 as illustrated in FIG. 6, it is possible to complete a series of processing including the write in the RFID tag, check processing and correction in a single system.

Although the explanation of the embodiments of the present invention is finished here, the invention is not limited to the above-described embodiments.

The invention claimed is:

1. A continuous paper processing system for continuous paper equipped with at least one RFID tag, said continuous paper processing system comprising:

a post-processing device for said continuous paper;

an RFID reader for reading electronic information written in said RFID tag;

storage means arranged for storing check information to be checked against the electronic information read by said RFID reader; and check means arranged for checking the electronic information read by said RFID reader against said check information, wherein said continuous paper previously has fold lines that extend across said continuous paper to define respective pages of said continuous paper;

each pace of said continuous paper is provided with said RFID tag; and said post-processing device folds said continuous paper at every fold line corresponding to the page for which said check means has completed checking the electric information obtained from the corresponding RFID tag against the check information.

2. The continuous paper processing system according to claim 1, wherein said storage means stores as log information at least any one of the electronic information read by said RFID reader, said check information used for the check by said check means, and result information of the check by said check means.

3. The continuous paper processing system according to claim 1, further comprising log storage means arranged for storing as log information at least any one of the electronic information read by said RFID reader, said check information used for the check by said check means, and result information of the check by said check means.

4. The continuous paper processing system according to claim 1, further comprising marking means arranged for giving marking onto said RFID tag or onto a nearby place from the tag on said continuous paper on the basis of a check result of said check means.

5. The continuous paper processing system according to claim 1, further comprising a correction RFID writer disposed downstream of said RFID reader as viewed in a feeding direction of said continuous paper for writing the electronic information in said RFID tag on the basis of the check result of said check means.

6. The continuous paper processing system according to claim 5, wherein said post-processing device can be alternately switched between a post-processing operation mode in which at least the feed of said continuous paper is performed and a standby mode in which the feed of said continuous paper is not performed; and wherein in the standby mode, write of electronic information into said RFID tag by said RFID writer or said correction RFID writer, and/or marking of said marking means is performed.

7. The continuous paper processing system according to claim 1, wherein said continuous paper previously has fold lines at prescribed intervals, and said RFID tag is attached onto said continuous paper on the basis of positions of said fold lines.

8. A continuous paper processing system for continuous paper equipped with at least one RFID tag and printed with visible information, said continuous paper processing system comprising:

a post-processing device for said continuous paper;

an RFID reader for reading electronic information written in said RFID tag;

a visible information reader for reading said visible information; and check means arranged for checking the electronic information read by said RFID reader against electronic information read by said visible information reader, wherein said continuous paper previously has fold lines that extend across said continuous paper to define respective pages of said continuous paper:

each page of said continuous paper is provided with said RFID tag; and said post-processing device folds said continuous paper at every fold line corresponding to the page for which said check means has completed checking the electric information obtained from the corresponding RFID tag against the check information.

9. The continuous paper processing system according to claim 8, further comprising storage means arranged for storing as log information at least any one of the electronic information read by said RFID reader, the electronic information read by said visible information reader, and result information of the check by said check means.

10. The continuous paper processing system according to claim 9, wherein:

said storage means includes:

log storage means arranged for storing as log information at least any one of the electronic information read by said RFID reader, the electronic information read by said visible information reader, and the result information of the check by said check means; and check-information storage means arranged for storing check information to be checked against the electronic information read by said RFID reader and/or the electronic information read by said visible information reader, and wherein:

said check means further checks the electronic information read by said RFID reader and/or the electronic information read by said visible information reader against said check information.

11. The continuous paper processing system according to claim 9, wherein:

said storage means further stores check information to be checked against the electronic information read by said RFID reader and/or the electronic information read by said visible information reader; and wherein:

said check means further checks the electronic information read by said RFID reader and/or the electronic information read by said visible information reader against said check information.

12. The continuous paper processing system according to claim 8, wherein:

said check means further checks the electronic information read by said RFID reader and/or the electronic information read by said visible information reader against check information; said continuous paper processing system further comprising:

storage means arranged for storing said check information and for storing as log information at least any one of the electronic information read by said RFID reader, the electronic information read by said visible information reader, said check information used for the check by said check means, and result information of the check by said check means.

13. The continuous paper processing system according to claim 12, wherein:

said storage means includes:

check-information storage means arranged for storing said check information; and log storage means arranged for storing as log information at least any one of the electronic information read by said RFID reader, the electronic information read by said visible information reader, said check information used for the check by said check means, and the result information of the check by said check means.

14. The continuous paper processing system according to claim 8, wherein said visible information includes a bar code or two-dimensional code, and said visible information reader has a function for reading a bar code or two-dimensional code.

15. The continuous paper processing system according to claim 8, further comprising marking means arranged for giving marking onto said RFID tag or onto a nearby place from the tag on said continuous paper on the basis of a check result of said check means.

16. The continuous paper processing system according to claim 8, further comprising a correction RFID writer disposed downstream of said RFID reader as viewed in a feeding direction of said continuous paper for writing the electronic information in said RFID tag on the basis of the check result of said check means.

17. The continuous paper processing system according to claim 16, wherein said post-processing device can be alternately switched between a post-processing operation mode in which at least the feed of said continuous paper is performed and a standby mode in which the feed of said continuous paper is not performed; and wherein in the standby mode, write of electronic information into said RFID tag by said RFID writer or said correction RFID writer, and/or marking of said marking means is performed.

18. The continuous paper processing system according to claim 8, wherein said continuous paper previously has fold lines at prescribed intervals, and said RFID tag is attached onto said continuous paper on the basis of positions of said fold lines.

19. The continuous paper processing system according to claim 8, wherein said RFID tag is attached on said continuous paper or said visible information is printed on said continuous paper.

20. The continuous paper processing system according to claim 8, wherein either one of the electronic information maintained in said RFID tag and said visible information includes a portion or key code of the other, or a portion or key code of the check information.

21. A continuous paper processing system for continuous paper equipped with at least one RFID tag, said continuous paper processing system comprising:

a post-processing device for said continuous paper;

an RFID writer for writing electronic information in said RFID tag;

an RFID reader for reading the electronic information from said RFID tag; and check means arranged for checking the electronic information written by said RFID writer against the electronic information read by said RFID reader, wherein said continuous paper previously has fold lines that extend across said continuous paper to define respective pages of said continuous paper;

each page of said continuous paper is provided with said RFID tag; and said post-processing device folds said continuous paper at every fold line corresponding to the page for which said check means has completed checking the electric information obtained from the corresponding RFID tag against the check information.

22. The continuous paper processing system according to claim 21, further comprising recording means arranged for storing as log information at least any one of the electronic information written in said RFID tag by said RFID writer, the electronic information read by said RFID reader, and result information of the check.

23. The continuous paper processing system according to claim 21, further comprising marking means arranged for giving marking onto said RFID tag or onto a nearby place from the tag on said continuous paper on the basis of a check result of said check means.

24. The continuous paper processing system according to claim 21, further comprising a correction RFID writer disposed downstream of said RFID reader as viewed in a feeding direction of said continuous paper for writing the electronic information in said RFID tag on the basis of the check result of said check means.

25. The continuous paper processing system according to claim 24, wherein said post-processing device can be alternately switched between a post-processing operation mode in which at least the feed of said continuous paper is performed and a standby mode in which the feed of said continuous paper is not performed; and wherein in the standby mode, write of electronic information into said RFID tag by said RFID writer or said correction RFID writer, and/or marking of said marking means is performed.

26. The continuous paper processing system according to claim 21, wherein said continuous paper previously has fold lines at prescribed intervals, and said RFID tag is attached onto said continuous paper on the basis of positions of said fold lines.

* * * * *